United States Patent [19]

Baum

[11] Patent Number: 4,632,705

[45] Date of Patent: Dec. 30, 1986

[54] PROCESS FOR THE ACCELERATED CLEANING OF THE RESTRICTED AREAS OF THE SECONDARY SIDE OF A STEAM GENERATOR

[75] Inventor: Allen J. Baum, Pittsburgh, Pa.

[73] Assignee: Westinghouse Electric Corp., Pittsburgh, Pa.

[21] Appl. No.: 591,638

[22] Filed: Mar. 20, 1984

[51] Int. Cl.[4] ..... B08B 3/10

[52] U.S. Cl. ..... 134/3; 134/22.18; 134/22.19; 134/34; 134/41

[58] Field of Search ..... 134/2, 3, 19, 22.18, 134/22.19, 34, 35, 41; 165/95; 376/310

[56] References Cited

U.S. PATENT DOCUMENTS

| | | | |
|---|---|---|---|
| 2,123,434 | 7/1938 | Paulson et al. | 134/22.19 |
| 3,438,811 | 4/1969 | Harriman et al. | 134/2 |
| 3,854,996 | 12/1974 | Frost et al. | 134/3 X |
| 4,238,244 | 12/1980 | Banks | 134/22.18 |
| 4,257,819 | 3/1981 | Abe et al. | 134/19 |
| 4,320,528 | 3/1982 | Scharton et al. | 376/310 |

*Primary Examiner*—George Yeung

*Attorney, Agent, or Firm*—Daniel C. Abeles

[57] ABSTRACT

A process for cleaning out deposits collected in the restricted areas of the secondary side of a steam generator of a nuclear power plant system, where the concentration of an aqueous organic cleaning agent solution is increased in the restricted areas, relative to the remainder of the solution. The solution is heated, at an initial pressure which prevents boiling of the solution, and the pressure is reduced to effect localized flashing and boiling of the solution in the restricted areas. After a period of time, the pressure is increased and the cleaning agent solution, containing solubilized deposits, is withdrawn from the secondary side of the steam generator. The heating temperature and pressure will vary depending upon the type of deposit to be removed, either ferrous-type or copper-type deposits.

10 Claims, 2 Drawing Figures

PROCESS FOR THE ACCELERATED CLEANING OF THE RESTRICTED AREAS OF THE SECONDARY SIDE OF A STEAM GENERATOR

FIELD OF THE INVENTION

The present invention relates to a process for cleaning of the flow restricted areas in the secondary side of a steam generator, and specifically a nuclear power plant steam generator to remove corrosion products or sludge, such as those which collect on the tubesheet, or in the tubesheet and tube support crevices.

BACKGROUND OF THE INVENTION

In pressurized water reactors for the nuclear production of power, a pressurized fluid is passed through the reactor core and, after being heated in the core, is passed through heat transfer tubes that are positioned in a secondary side of a steam generator. In the secondary side of the steam generator, the heat transfer tubes transfer heat to a secondary fluid to produce steam that is then used to operate a turbine for production of electrical power.

During the operation of the steam generator, impurities find their way into the secondary fluid and tend to concentrate in flow restricted regions in the secondary side of the steam generator. These restricted regions may result from the accumulation of deposits within the generator. The concentrated solutions in the restricted regions can lead to accelerated corrosion of the heat transfer tubes and structural components.

In an effort to prevent the accumulation of deposits in the secondary side of the steam generator, many approaches have been used. One approach has been to blow down the steam generator to remove as much of the impurities as possible from the secondary fluid and dispose of the same. Even with the use of such an approach, however, deposits are still found to be accumulated in the secondary side of the steam generator.

Since deposits are still accumulated in the secondary side of the steam generator, flushing operations have been proposed to periodically remove as much of the dissolved impurities from the flow restricted areas as possible. Such a flushing operation may be effected by introducing a quantity of water into the secondary side of the steam generator while the pressureized water reactor system is at cold shutdown, applying a nitrogen over-pressure, heating the steam generator to about 140° C. using the reactor coolant pumps, and then depressurizing the generator by opening of power-operated relief valves. The valves are subsequently closed and the cycle is repeated. Such a procedure helps to remove sludge from the tubesheet and from crevices found in the secondary side.

Even with the use of such a flushing operation, however, the removal of concentrated solutions of impurities from flow restricted areas of the secondary side components has not been as efficient as desired. Such flow restricted areas include the annular gap between the heat transfer tubes and the tubesheet, as well as gaps between the tubes and supporting devices for the tubes, or separator plates. In U.S. Pat. No. 4,257,819, a process is described for flushing out a narrow gap, such as the gap between a heat transfer tube and a tubesheet of a steam generator. As described therein, clean water, or alternatively, an organic solvent, are added to the secondary side, the water pressurized to about 3 atmospheres by an air compressor, and localized heating, by a heating device, is applied to the bottom of the gap between a heat transfer tube and the tubesheet. The pressure in the secondary isde is then reduced to cause flashing of water in the gap. Alternately, the repeating of pressurization and reduction in pressure can be used. Such a method is intended to flush the tubesheet crevice annulus.

SUMMARY OF THE INVENTION

The deposits collected in the secondary side of a steam generator of a nuclear power plant system, and especially those deposits collected in the restricted areas of the secondary side, are solubilized in an aqueous organic cleaning agent by localized flashing and boiling of the cleaning agent solution in those restricted areas with resultant concentration of the cleaning agent solution in the restricted areas. A supply of aqueous organic cleaning agent solution is charged to the secondary side and the solution heated, by passage of heated fluid through the heat transfer tubes passing through the secondary side, while an initial pressure is maintained in the secondary side to prevent boiling of the solution. The pressure in the secondary side is then reduced, while heating is maintained, such that localized flashing and boiling of the aqueous organic cleaning agent solution is effected in the restricted areas with a resultant increase in the concentration of the solution in the restricted areas. After a period of time sufficient to concentrate the solution,the pressure is returned to at least the initial pressure, solubilization of the deposits effected, and the aqueous cleaning agent solution containing solubilized deposits is withdrawn from the secondary side of the steam generator. The heating, pressurization, depressurization and repressurization may be repeated more than once prior to the withdrawing of the solution, or a series of the pressurization, depressurization, repressurization and withdrawing steps may be effected using fresh supplies of cleaning agent solution.

In removing ferrous material-containing deposits, an elevated temperature of about 120°–135° C. is used along with an initial pressure of about 2–3 atmospheres, while in removing copper-containing deposits, hydrogen peroxide or other oxidant is added to the aqueous organic cleaning agent solution and an elevated temperature of about 30°–40° C. used along with an initial pressure of no higher than 0.15 atmosphere.

DETAILED DESCRIPTION

In the present process, the sludge and deposits that tend to collect in the restricted areas of a steam generator secondary side are removed therefrom by an aqueous cleaning solution, containing organic cleaning agent, with the concentration of the cleaning solution increased in the region of said restricted areas.

Figure 1:
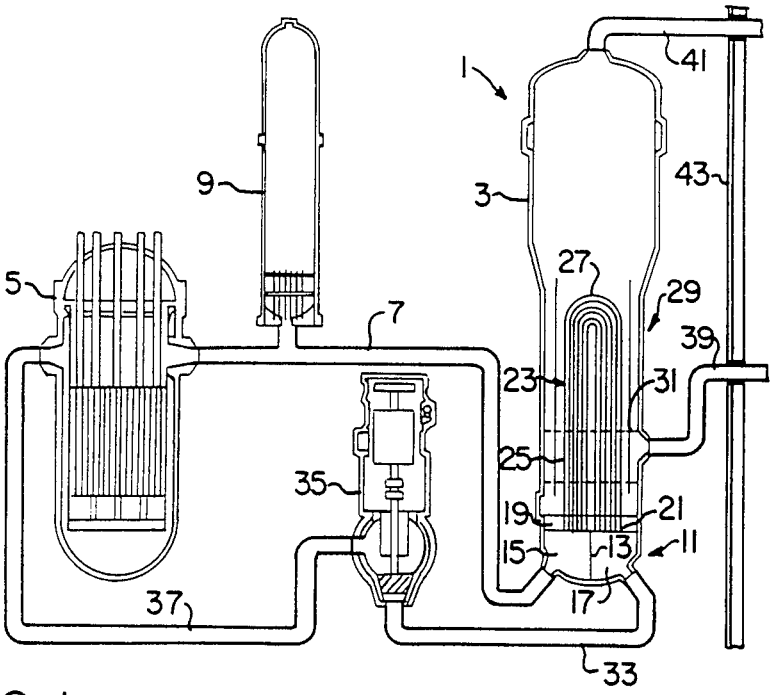
FIG. 1 schematically illustrates a nuclear power plant system containing a steam generator, with fluid flow through the primary and secondary sides of the steam generator shown.

Referring now to FIG. 1, a nuclear steam supply system 1, is illustrated, containing a steam generator 3. In the primary loop of the steam generation system, a pressurized fluid is passed through the reactor 5, then after being heated, through line 7, which contains a pressurizer 9, (on one loop only) to the steam generator 3. The heated fluid enters the primary side 11 of the steam generator 3 which is divided in half by a vertical divider plate 13 into an inlet section 15 and outlet section 17. A tubesheet 19 divides the steam generator 3 into the primary side 11 and a secondary side 29. The tubesheet 19 is provided with an array of holes 21 through which several thousand U-shaped heat transfer tubes 23 are inserted. The U-shaped tubes 23 each have leg portions 25 and a U-bend portion 27. The leg portions 25 are inserted into corresponding holes 21 on opposite sides of the tubesheet 19 so that one end communicates with the inlet section 15 and the other end communicates with the outlet section 17. The leg portions 25 of the U-shaped tubes 23 are supported and stabilized on the secondary side 29 of the generator 3 by a series of separator plates 31 which are stabilized axially by tie rods.

In operation, the heated pressurized fluid entering the inlet section 15 of the primary side 11, circulates through the U-shaped tubes 23 and exits the outlet section 17 of the primary side 11 to a line 33 which passes the fluid to a coolant pump 35 and then through line 37 back to the reactor 5 in a continuous closed loop. Secondary water is introduced into the secondary side 29 of the steam generator 3 through secondary water inlet 39, and circulates around the U-shaped tubes 23 where it is converted into steam by heat released by the primary coolant passing through tubes 23. The steam produced in the secondary side 29 rises into a steam drum (not shown), where water droplets are removed by demisters, and passes out of the steam generator 3 through a secondary outlet 41 for use in driving of turbines to produce energy, condenses in a condensor, outside a containment 43, and returns to the secondary inlet 39 of the steam generator 3 in a continuous loop. The loop also contains conventional relief valves, and steam dump valves (not shown).

Figure 2:
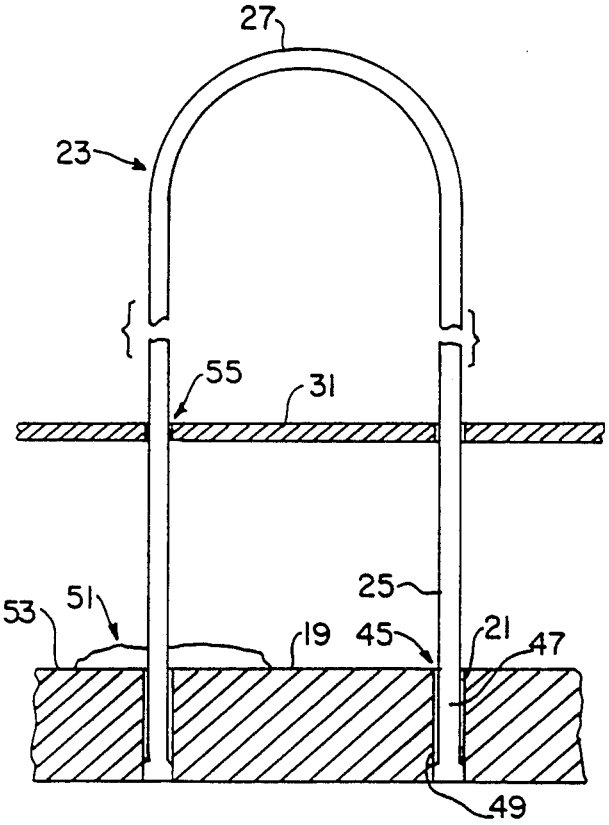
FIG. 2 schematically illustrates a portion of the secondary side of a steam generator to show restricted areas therein where deposits collect.

In the schematic illustration of FIG. 2, restricted areas in the steam generator 3, wherein deposits can collect and pose corrosion concerns are illustrated. As shown, a crevice 45 exists between the lower section 47 of the leg 25 of the heat transfer tube 23 and the wall 49 in the tubesheet 19 surrounding the hole 21. Sludge 51 collects on the surface 53 of the tubesheet 19 and may also collect in the crevice 45. In addition, further crevices 55 exist between the heat transfer tubes 23 and the tube support plates 31. It is to the removal of deposits from these restricted areas (45, 53, 55) that the present process is specifically directed.

Existing processes for chemically cleaning such generators call for the cleaning agent to be applied under either a low temperature (20°–150° C.) soak mode or a high temperature (275°–305° C.) power operation mode. The chief concern resulting from applying a cleaning agent in the soak mode is that the relatively long time durations required for the cleaning agent to diffuse into the flow restricted areas of the generator and the required high concentration of cleaning agent may result in excessive corrosion of steam generator components, such as the tube sheet, separator plates, and other components. In a diffusion controlled process, the cleaning agent concentration must always be lower in the flow restricted areas than in the bulk fluid. The concentration in the flow restricted areas will be further depleted by chelating reactions with the adjacent corrosion products. As a consequence, the time required for the complete cleaning of a sludge pile or packed crevice may be unacceptably long from an operational standpoint and be too risky for the generator components. The chief concern with on-line, or power operation mode, cleaning agent applications is that the cleaning agent is likely to disassociate at operating temperatures and local corrosion rates may be unpredictable. In addition, the disassociation products may produce turbine corrosion concerns which have not yet been evaluated. As a consequence of the concerns associated with both the on- and off-line processes, chemical cleaning has not yet been applied to any large nuclear steam generator after the unit has commenced operation.

The present process differs from existing cleaning processes in that the organic cleaning agent is transported into the flow restricted areas of the steam generator by convection rather than by diffusion and is concentrated in the flow restricted areas by boiling processes. As a consequence, the rate of ingress of the cleaning agent into the flow restricted areas is increased compared to diffusion controlled processes and the bulk concentration of the organic cleaning agent required for the cleaning of the flow restricted area can be substantially reduced.

The convective and concentration mode of cleaning of the present invention is produced by depressurizing the secondary side of the steam generator, containing an aqueous organic cleaning agent solution, at temperatures of between about 120°–135° C., maintaining the secondary side of the steam generator in a depressurized state for a period of time, and then repressurizing the generator, and repeating these steps to solubilize deposits therein. Depressurizing the generator produces flashing and boiling of the aqueous organic cleaning agent solution within the generator. The boiling processes should continue as long as the generator is depressurized. These boiling processes are analogous to the boiling processes which occur during power operation, so that the cleaning agent solution should be concentrated in the flow restricted areas at which corrodants can be concentrated during power operation.

The corrosion products within the flow restricted areas are solubilized by the concentrated cleaning agent solution. Application of a nitrogen gas overpressure will accelerate the penetration of the concentrated solution into the restricted areas following the repressurization so that vapor within the flow restricted areas is collapsed. Although the concentration process may result in the local precipitation of the organic cleaning agent, the precipitate should then return to solution as the dissolution process dilutes the cleaning agent concentration.

In previously recommended cleaning agent formulations for use in cleaning the secondary side of a steam generator, the amount of organic acid, such as ethylenediaminetetraacetic acid (EDTA) or citric acid was in the range of 7.5–20 percent by weight. For example, in "A Chemical Cleaning Process for Nuclear Steam Generators", Balakrishnan, P. V. et al., presented at the International Conference on Materials Performance in Nuclear Steam Generators, ANA, St. Petersburg, Fla., Oct. 6th–9th, 1980, a formulation containing 8 percent EDTA and 2 percent citric acid was suggested. Also, in the paper entitled "Chemical Cleaning of Nuclear (PWR) Steam Generators", Wetly, C. S., et al. presented at the American Power Conference, Chicago, Ill., Apr. 26–28, 1982, various formulations are disclosed.

In the present process, much lower concentrations of the acidic constituents are usable since a substantial increase in the flow restricted areas, relative to the remainder of the generator. The use of relatively dilute solutions in the crevice should alleviate the free surface corrosion concerns associated with the use of concentrated cleaning solutions. Bulk concentration between 2–20% of previous recommendations are preferably used. This is a result of the ability to increase the concentration of the solution in the restricted areas, at least about five times, that of the remaining solution in the steam generator.

In the present process, an aqueous solution of an organic cleaning agent is charged to the secondary side of the steam generator while the plant is at cold shutdown. The organic cleaning agents are selected from conventional cleaning agents useful in solubilizing deposits formed in a steam generator, and will vary depending upon the particular deposits that are to be removed from the generator and upon the constituents occupying the pores of the deposit. In the removal of unconsolidated iron bearing sludge deposits, a useful solution would comprise ethylenediaminetetraacetic acid (EDTA), hydrazine, a corrosion inhibitor, ammonium hydroxide and a dispersant, in water. For the removal of consolidated iron deposits, the above solution would be usable by substituting triethanolamine for the ammonium hydroxide.

In instances where the removal of deposits from tube support crevices, those crevices between the heat transfer tubes and tube support plates, is specifically desired, a useful solution would comprise EDTA, a corrosion inhibitor, a surfactant, and triethanolamine in water.

In instances where the removal of deposits from the tubesheet crevices, those crevices between the heat transfer tubes and the tubesheet, is specifically desired, a useful solution would comprise EDTA, citric acid, ascorbic acid, hydrazine, a hydroxy substituted amine such as tetrakis (2-hydroxypropyl ethylenediamine), a surfactant, a corrosion inhibitor, and triethanolamine, in water.

After charging the generator with the aqeuous organic cleaning agent, the interior of the secondary side is heated to a temperature of between 120°–130° C. by passage of heated fluid through the primary side of the steam generator and through the heat transfer tubes, which fluid can be heated by operating the coolant pump in the primary system. This heating will increase the pressure to about 3 atmospheres. While carrying out the heating, a nitrogen overpressure of about 0.5–1 atmosphere is maintained over the secondary side of the steam generator containing the cleaning solution. The nitrogen overpressure aids in controlling the concentration of cleaning agent achieved in the generator and prevents boiling from occuring except when desired.

After the desired elevated temperature has been achieved, the pressure in the secondary side is reduced by opening of existing valves, with nitrogen gas and steam beld off from the generator, while maintaining the heating through the heat transfer tubes. The reduction in pressure causes localized flashing and boiling of the aqueous organic cleaning agent solution in the secondary side of the steam generator, while increasing the concentration of the cleaning agent solution in the flow restricted areas.

The reduction in pressure, with continued heating, is maintained for a period of time to concentrate the solution in the restricted areas. The time will vary depending upon the type of deposit and the amount of the deposits present. After a period of time at the reduced pressure, the steam generator is repressurized to the initial elevated pressure. The solution, with concentration achieved in the restricted areas, is maintained in the secondary side for a period of time sufficient to substantially fully solubilize the deposits. The cleaning agent solution containing the solubilized deposits is then drained from the generator. The pressurization and depressurization may be repeated after addition of a fresh supply of the aqueous organic cleaning agent solution. Or, the initial supply of cleaning agent solution may be subjected to additional pressurization and depressurization steps, while maintained at the elevated temperature, prior to draining of the same from the generator. Generally, the initial supply of cleaning agent will be drained from the steam generator after a single depressurization step, while subsequent supplies of cleaning agent solution will be subjected to more than one pressurization and depressurization step prior to being drained from the generator. The steps are repeated until the deposits have been removed from the generator.

In another emobdiment of the present invention, copper-bearing deposits can be removed from the secondary side of the steam generator by the use of a lower temperature and pressure, and addition of an oxidant, such as hydrogen peroxide, to the organic cleaning solution. In the removal of copper-bearing deposits, the aforedescribed process steps are carried out except that the temperature to which the cleaning agent solution is heated in the secondary side of the steam generator should be in the range of between about 30°–40° C., and the pressure would be subatmospheric pressure, no higher than 0.15 atmosphere, throughout the secondary coolant system including the secondary side of the steam generator. The particular temperature and pressure would depend upon the conditions to be used. For example, using a temperature of about 38° C., the pressure would be about 0.065 atmosphere, so as to prevent boiling and flashing of the cleaning agent solution until desired.

Cleaning agent solutions for copper deposit removal would, for example, contain EDTA, hydrogen peroxide, ammonium hydroxide, ehtylenediamine and a dispersant.

The present process provides an accelerated chemical cleaning of the restricted areas of a steam generator by concentration of the cleaning agent solution in the restricted areas of the secondary side. Thus, the use of substantially lower bulk concentrations of cleaning agents are usable while effecting efficient cleaning of the restricted areas.

What is claimed is:

1. A process for cleaning the restricted areas of the secondary side of a steam generator, through which heat transfer tubes of the primary side of the steam generator pass, said restricted areas including the crevices between heat transfer tube legs and the tubesheet, and the crevices between the heat transfer tubes and tube support plates, with an aqueous solution of an organic cleaning agent which will solubilize deposits collected in said secondary side, comprising:

(a) heating the interior of the secondary side of the steam generator, containing an aqueous organic cleaning agent solution to an elevated temperature by passage of heated fluid through the primary side of the steam generator and heat transfer tubes passing through said secondary side, while maintaining said secondary side at an initial pressure which will prevent boiling of the aqueous organic cleaning agent solution at said elevated temperature;

(b) reducing the pressure in the secondary side of the steam generator, while maintaining said heating, so as to cause localized flashing and boiling of the aqueous organic cleaning agent solution therein, such that the concentration of said aqueous organic cleaning agent is increased in the region of all said restricted areas;

(c) maintaining said reduced pressure in the secondary side of the steam generator, while maintaining said heating, for a period of time sufficient to concentrate said solution in all said restricted areas relative to the remainder of the bulk solution in the secondary side of the steam generator;

(d) increasing the pressure in the secondary side of the steam generator to at least said initial pressure;

(e) maintaining said aqueous organic cleaning solution in said secondary side of the steam generator, for a period of time sufficient to solubilize said deposits; and (f) withdrawing said aqueous organic cleaning agent solution containing solubilized deposits from the secondary side of said steam generator.

2. The process as defined in claim 1 wherein, prior to the withdrawing of step (f), steps (b) through (e) are repeated, in seuence, at least once.

3. The process as defined in claim 1 wherein steps (a) through (f) are repeated, in sequence, a plurality of times.

4. The process as defined in claim 1 wherein said deposits comprise ferrous-containing material.

5. The process as defined in claim 4 wherein said elevated temperature is between about 120°–135° C. and said initial pressure is at least about 2 atmospheres.

6. The process as defined in claim 5 wherein said initial pressure is maintained by introducing pressurized nitrogen to the secondary side to about 0.5–1.0 atmosphere above said initial pressure.

7. The process as defined in claim 1 wherein the concentration of said aqueous organic cleaning agent is increased in said restricted areas to a concentration of at least five times the concentration of the remainder of the aqueous organic cleaning agent in said secondary side.

8. The process as defined in claim 1 wherein said deposits comprise copper-containing material and an oxidant is added to said aqueous organic cleaning agent solution.

9. The process as defined in claim 8 wherein said elevated temperature is between about 30°–40° C. and said initial pressure is no higher than 0.15 atmosphere.

10. The process as defined in claim 9 wherein said oxidant is hydrogen peroxide.

* * * * *